US005150887A

United States Patent [19]

Weissenborn et al.

[11] Patent Number: 5,150,887

[45] Date of Patent: Sep. 29, 1992

[54] SKI HOLDING DEVICE

[75] Inventors: Richard K. Weissenborn; Gregory A. Komitsch, both of Calgary, Canada

[73] Assignee: James B. Anderson, by said Gregory A. Komitsch

[21] Appl. No.: 656,769

[22] Filed: Feb. 15, 1991

[51] Int. Cl.[5] ..... B23Q 1/04

[52] U.S. Cl. ..... 269/71; 269/906; 269/210; 269/299; 269/301

[58] Field of Search ..... 269/45, 71, 77, 82, 269/42, 63, 47, 48.1, 906, 296, 297, 299, 301, 303, 315, 319

[56] References Cited

U.S. PATENT DOCUMENTS

| | | | |
|---|---|---|---|
| 3,854,712 | 12/1974 | McGee | 269/153 |
| 3,977,663 | 8/1976 | Kohler | 269/153 |
| 4,253,649 | 3/1981 | Hewson | 269/45 |
| 4,262,890 | 2/1981 | Sisko | 269/21 |
| 4,522,379 | 6/1985 | Lindgren | 269/906 |

FOREIGN PATENT DOCUMENTS

| | | | |
|---|---|---|---|
| 375023 | 6/1984 | Austria . | |
| 999314 | 11/1976 | Canada | 269/11 |
| 1015378 | 8/1977 | Canada | 269/11 |
| 1017762 | 9/1977 | Canada | 269/11 |
| 1088114 | 10/1980 | Canada | 269/11 |
| 1223553 | 6/1987 | Canada | 211/10 |
| 0247319 | 12/1987 | European Pat. Off. . | |
| 2645023 | 4/1978 | Fed. Rep. of Germany . | |
| 3243559 | 3/1983 | Fed. Rep. of Germany . | |
| 3910316 | 10/1990 | Fed. Rep. of Germany . | |
| 2541125 | 8/1984 | France . | |

*Primary Examiner*—Bruce M. Kisliuk
*Assistant Examiner*—Eileen Morgan
*Attorney, Agent, or Firm*—Stevens, Davis, Miller & Mosher

[57] ABSTRACT

The present invention relates to an improved ski holding device for mounting a ski on a table such as a work bench to prepare the ski base and edges. Problems presented by the new trapezoidal and monocoque designs are overcome by using a simulated ski boot to mount the ski. The mounting also provides for pivoting the ski from a position in which the base is horizontal with the ski inverted, positions in which the base of the ski is vertical and intermediate positions and holding the ski in such orientation. There is additional locking means for holding the base in a horizontal and inverted position. There is also provision for easily disengaging a boot portion of the holding device from a mounting portion of the holding device to reverse the direction in which the ski is pointing.

23 Claims, 8 Drawing Sheets

SKI HOLDING DEVICE

The present invention relates to an improved ski holding device wherein a ski is mounted on a stationary support such as a work bench or the like to allow for the preparation of the ski base and edges.

The manufacture of skis has undergone revolutionary technological changes both in the materials used and the methods of production. The cross-section of the ski has been traditionally of a rectangular box design which was predominant in 1985. Skis with a trapezoidal cross-section were introduced by Fischer and the monocoque design by Salomon entered the test market in 1989/1990 and is scheduled for mass entry into the ski market in the winter of 1990.

Skis are an expensive sporting apparatus which require frequent maintenance or "tuning" to ensure optimal performance and prolonged useful life. Tuning includes the cleaning, repair, texturing and waxing of the plastic base material as well as filing and preparation of the metal edges to remove roughness and provide a smooth, sharp running surface. Such tuning must be repeated throughout the life of the skis.

Traditionally skis of the rectangular box design have been secured to a work bench by conventional vises using compression to hold the skis in place. Adapters are required to secure skis of trapezoidal cross section to a conventional vise. These adapters are only marginally effective and are inconvenient to use. Skis both of the rectangular box and trapezoidal design are sensitive to lateral compression and the plastic material of the base of the ski is easily damaged by compression applied by the jaws of a vise. The situation is therefore that there is a risk of damage from clamping compression even with the rectangular box design. This risk remains with trapezoidal designs and there is additional inconvenience.

With the introduction of the monocoque design the foregoing problems are intensified. There are no satisfactory adapters and damage becomes probable if conventional vises are used.

Another problem presented by skis of trapezoidal and monocoque design is that it may be desired to mount the skis at an inclination to the vertical while sharpening the edges. This cannot be achieved with conventional devices.

A further problem is that the person tuning a ski may have preferences as to whether he uses his right hand or left hand to tune both edges. When adapters are needed, it is difficult to rotate the ski 180° so that its tip is facing in a direction opposite to its former direction.

Another inconvenience when using a conventional vise is that a brake holder must be used. Many skis have a brake including prongs which pivot to a lowered position to dig into the snow when a boot is released from a binding, but which are retained retracted when a boot is in place. These brakes will seriously interfere with tuning unless they are retracted.

It is important that any ski holding device hold the ski firmly, particularly when the ski is inverted with its base horizontal. Shaving, which involves the application of substantial pressure, is done with the base horizontal.

There are a number of prior art references which disclose various means for mounting a ski or skis on a work surface. Early prior art devices include those in which the skis themselves are clamped directly into the clamping or mounting device which is then secured by other means to the work bench or table. U.S. Pat. No. 3,854,712 to McGee discloses such a device wherein the ski to be tuned is secured within a vise which clamps either the edges of the ski or the top and bottom surfaces of the ski directly. Such clamping devices are undesirable in that they deform the surfaces to which they are clamped. In order to avoid this major disadvantage, other prior art devices provide other means to hold or mount a ski in a horizontal position. U.S. Pat. No. 4,262,890 to Sisko et al describes a ski holding device which utilizes a vacuum ski gripping force generated against the upper surface of the ski by a vacuum pad. This device, however, lacks flexibility as it does not allow for mounting of the ski in any position other than with the bottom or running surface facing upwards.

Swedish Patent No. 7,513,771-1 (Publication No. 395368) discloses a ski holder which makes use of the ski binding for securing a ski in a position with the running surface turned upwards. Again, however, this device does not allow for securement of the ski in positions other than the horizontal position.

U.S. Pat. No. 4,522,379 to Lindgren discloses another ski holder which utilizes a boot dummy for mounting a ski to be tuned, utilizing the ski binding. The mounting of the boot dummy within the holder of the Lindgren device, however, has marked disadvantages in that the boot dummy must be disengaged from the holder in order to move the ski from one predetermined position to another and, further, the device only allows for positioning of the ski in three positions, horizontal and the two vertical positions. This latter limitation is particularly undesirable for the tuning of the new varieties of skis which resulted from recent developments in ski technology. These new downhill skis have cross-sections which are trapezoidal or monocoque in device for mou other than at either vertical position or a horizontal position.

Finally, German Patent No. 3,243,559 to Stettler discloses a ski holder device which utilizes an adjustable boot dummy for mounting a ski utilizing the binding, together with vacuum cups. The Stettler device does not seem to have any provision for locking the base in a horizontal and inverted position. Also it would be difficult and time consuming to reorient the ski through 180° with its tip pointing in a direction opposite to its previous direction.

SUMMARY OF THE INVENTION

A ski holding device is provided for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; said mounting portion having a base and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, and holding means which can be tightened for maintaining the ski in each of said positions and in intermediate positions and additional means for locking the base in a horizontal and inverted position.

The additional means for locking the base provides firm support when most needed, that is to say when the ski is inverted with its base horizontal.

Another important inventive feature in accordance with the preferred aspect of the invention, is that the boot portion can readily be removed from the mounting portion and replaced to point the ski tip in a direction opposite to its previous direction.

According to a preferred aspect of this invention the dependent tongue of the boot portion may have an open ended slot engaged by the means for pivotally connecting the mounting plate and tongue to permit this easy removal. The slot in the dependent tongue may also engage a stop to provide the additional means for locking the base.

The foregoing feature of an open ended slot with a dual function may also be used to provide a device for holding the ski tip or tail.

DETAILED DESCRIPTION OF THE INVENTION

Figure 1:
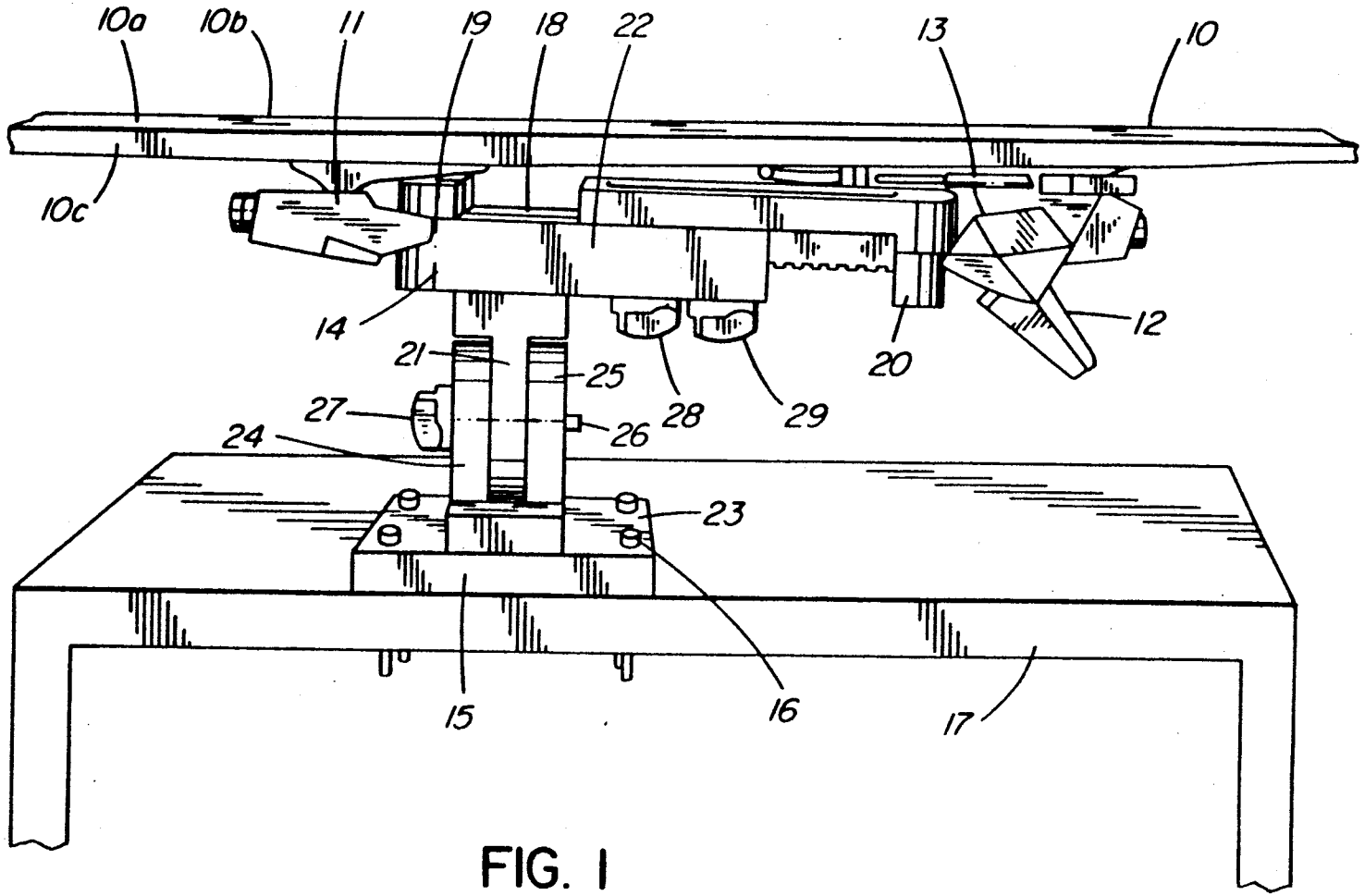
FIG. 1 is a perspective view generally illustrating a ski holding device in accordance with this invention.
Figure 2:
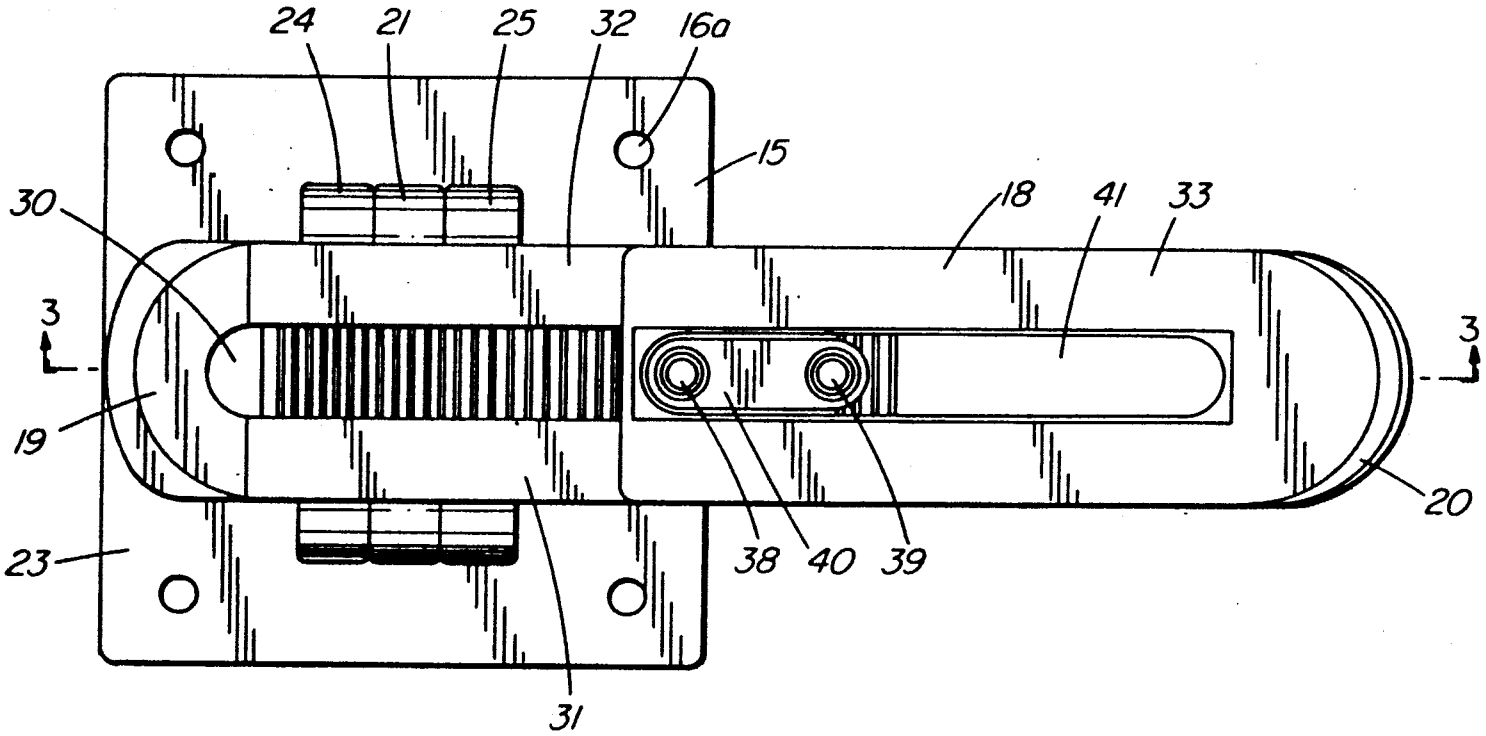
FIG. 2 is a plan view of the ski holding device of FIG. 1.
Figure 3:
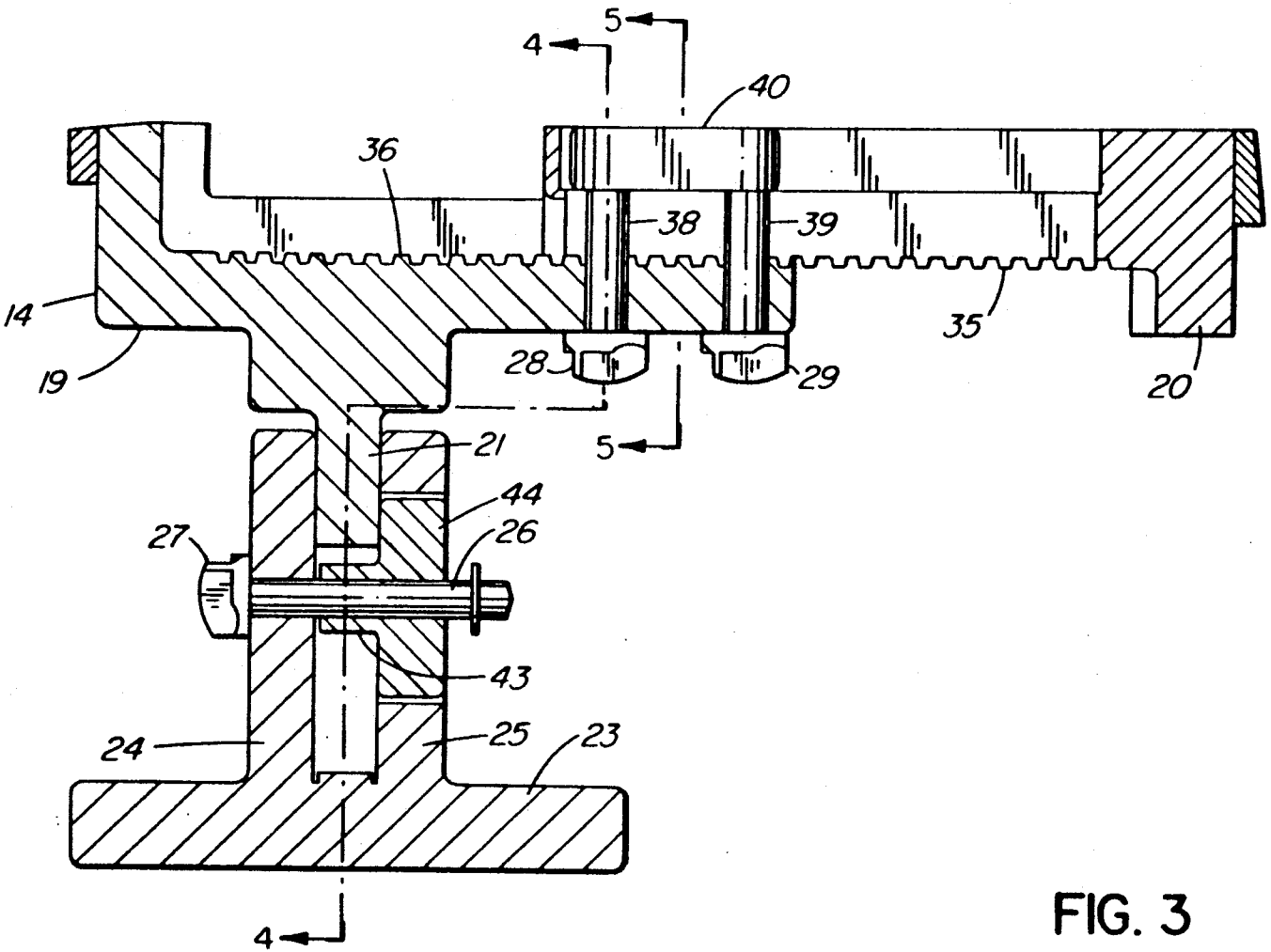
FIG. 3 is a section view on the line 3—3 of FIG. 2.

Referring now to the drawings in which the same or corresponding parts are identified by the same reference numeral FIG. 1 shows a ski 10 having bindings including a toe piece 11 and a heel piece 12. The ski will often also have a brake 13 which pivots to dig into the snow when the ski boot leaves the binding.

The ski holding device in accordance with this invention generally comprises a boot portion 14 simulating a ski boot, and a mounting portion 15. Mounting portion 15 is illustrated as being bolted by bolts 16 to a table such as a work bench 17. However FIGS. 9 and 10 will illustrate a special clamp which may optionally be used.

The sole 18 of boot portion 14 has a front part 19 adapted to engage toe piece 11 and a rear part 20 adapted to engage heel piece 12. The sole is preferably shaped in accordance with the German Industrial Norm (D.I.N) specifications for ski boots. These specifications call for a width of from 6.7 to 7.1 mm for sizes 3½ and up and there are specifications also as to the radius and other dimensions of the heel and toe. The front part 19 and rear part 20 of the boot portion 14 have an adjustable spacing to simulate different sizes of ski boots. Boot portion 14 also has a supporting tongue 21 dependent from the upper section 22 of the boot portion 14. As illustrated, tongue 21 is offset to be closer to the toe piece 11 than the heel piece 12. This provides improved balance, as bindings are closer to the back of the ski than the tip.

The mounting portion 15 includes a base 23 and mounting plates 24 and 25 extending upwardly from base 23. Supporting tongue 21 is sandwiched between mounting plates 24 and 25, and these are pivotally connected by a pin 26. Outer knob 27 controls pin 26 which has a threaded portion (not shown in FIG. 1) so that knob 27 can be tightened to clamp supporting tongue 21 to mounting plate 24.

Boot portion 14 may be positioned as shown in FIG. 1 with the base **10*a* of the ski horizontal and inverted or it can be pivoted so that the base 10*a* of the ski is vertical and facing the viewer of FIG. 1 with one side edge 10*b* uppermost or facing away with the other side edge 10*c* uppermost. It can also be maintained in intermediate positions by tightening knob 27**.

Brake 13 will automatically be retracted due to boot portion 14 being in the binding.

Adjustment of front part 19 and rear part 20 of boot portion 14 is accomplished by loosening knobs 28 and 29 to permit relative telescoping movement between front part 19 and rear part 20, following which knobs 28 and 29 are tightened.

Figure 4:
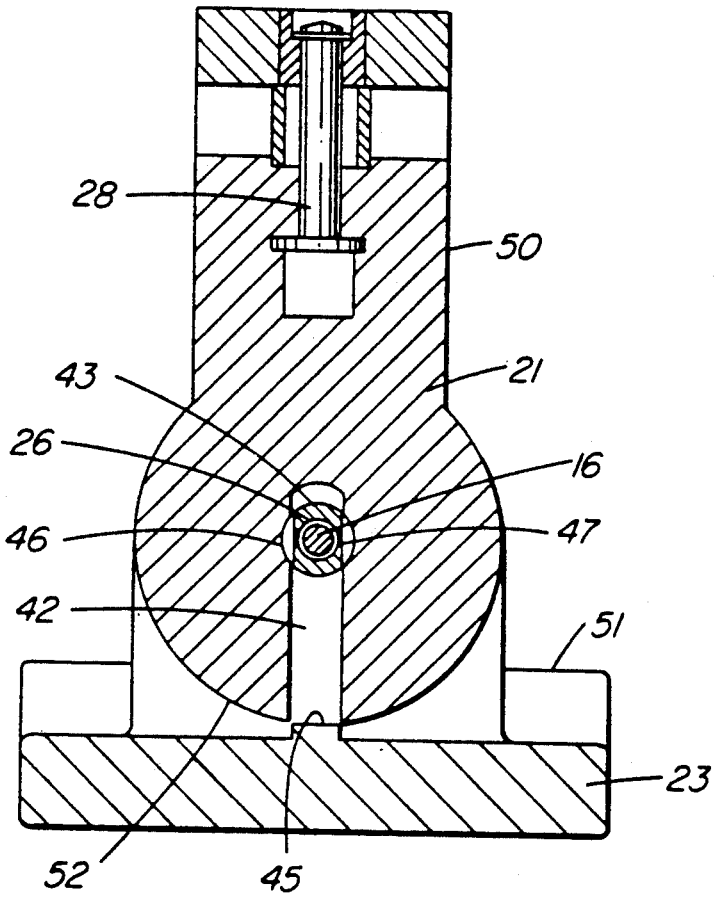
FIG. 4 is a section view on the line 4—4 of FIG. 3.
Figure 5:
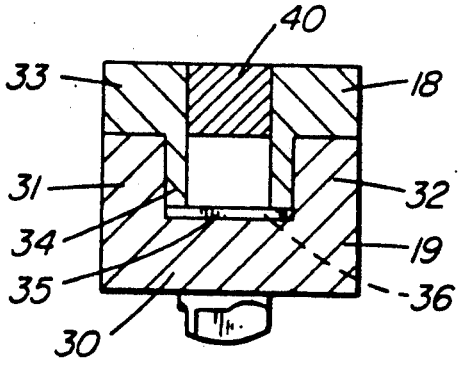
FIG. 5 is a section view on the line 5—5 of FIG. 3.

Referring now to FIGS. 2, 3, 4 and 5 of the drawings, the front part 19 of the boot portion has a U-shaped section as best shown in FIG. 5 including a base 30 and side walls 31 and 32. Rear part 18 has a T-shaped section including upper sole plate 33 and stem 34. At the bottom of stem 34 there are teeth 35 (best shown in FIG. 3) which mate with teeth 36 at the base of the U-shaped section. It is preferred that 100 mm. of potential adjustment be provided with 10 mm. increments as successive teeth are engaged. Knobs 28 and 29 may be tightened to turn bolts 38 and 39 respectively which threadably engage slide 40. Knobs 28 and 29 may be loosened to permit adjustment of the boot size and then tightened to maintain firm interlocking of front and rear portions 19 and 20. Slide 40 is movable along a slot 41 in the sole plate 33.

As best shown in FIG. 4, tongue 21 has a open ended slot 42 extending vertically from just above pivot pin 16 to the bottom of tongue 21. Slot 42 receives a reduced part 43 of boss 44. Reduced part 43 is shaped so that it will permit tongue 21 to slide up or down when tongue 21 is in the vertical position, as shown in FIG. 4. Tongue 21 can therefore be moved down to engage a locking projection 45 on base 23 with slot 42. This has an important function of providing means additional to knob 27 for locking the holder to maintain the base of the ski in a horizontal position. This is the position where there is most likely to be pressure during shaving or similar operations.

Slot 42 has an enlarged circular portion 46 so that part 43 of the boss will normally rotate within circular portion 46 with the slot 42 disengaged from locking projection 45, except when the flattened sides 47 of part 43 permit the tongue 21 to slide up or down.

The sliding of tongue 21 with respect to boss 44 has a further important function in that knob 27 may be loosened with the ski base in a horizontal position and having its tip facing in one direction, the boot portion 14 can be lifted up and replaced, after orienting the ski, with its tip facing in an opposite direction. This can be most convenient for people who have a preference as to the hand used for tuning.

Figure 6:
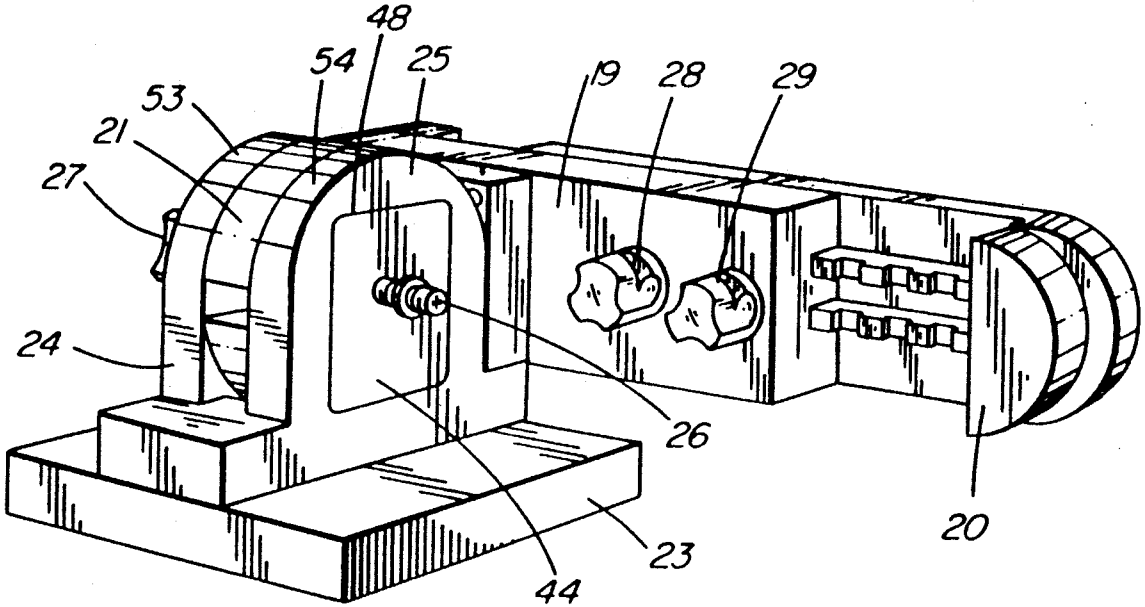
FIG. 6 is a perspective view showing the ski holding device in position for holding a ski with its base vertical.

Boss 44 is square and fits in a square recess 48 in plate 25, as best shown in FIG. 6. Pin 26 threadably engages boss 44 so that, as knob 27 is turned, boss 44 bears against tongue 21 to retain it in any desired position including the ski base horizontal, the ski base vertical with either edge uppermost and an infinite variety of intermediate positions. These intermediate positions may be preferred during the sharpening of the edges of skis with trapezoidal or monocoque cross-section.

The extent of rotational movement of tongue 21 with respect to base 23 may be limited by the abutment of portion 50 of tongue 21 with shoulder 51. Movement in the other direction may be similarly limited. These shoulders provide additional security against unintended movement of the skis during tuning and also provide a reference point to make it easy to orient the ski with its base exactly vertical.

As best illustrated in FIGS. 4 and 6, the bottom part 52 of tongue 21 is rounded and the tops 53 and 54 of plates 24 and 25 are also rounded to facilitate unimpeded rotation.

Figure 8:
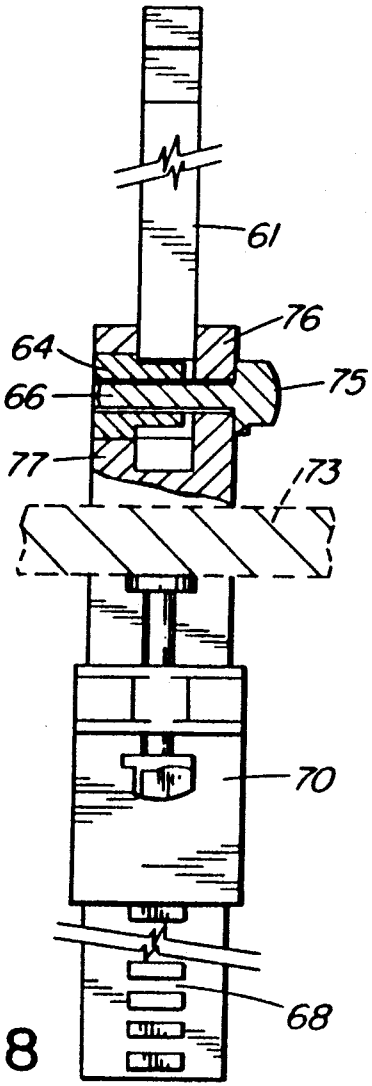
FIG. 8 is an end elevation view partly in section of the embodiment in FIG. 7.
Figure 7:
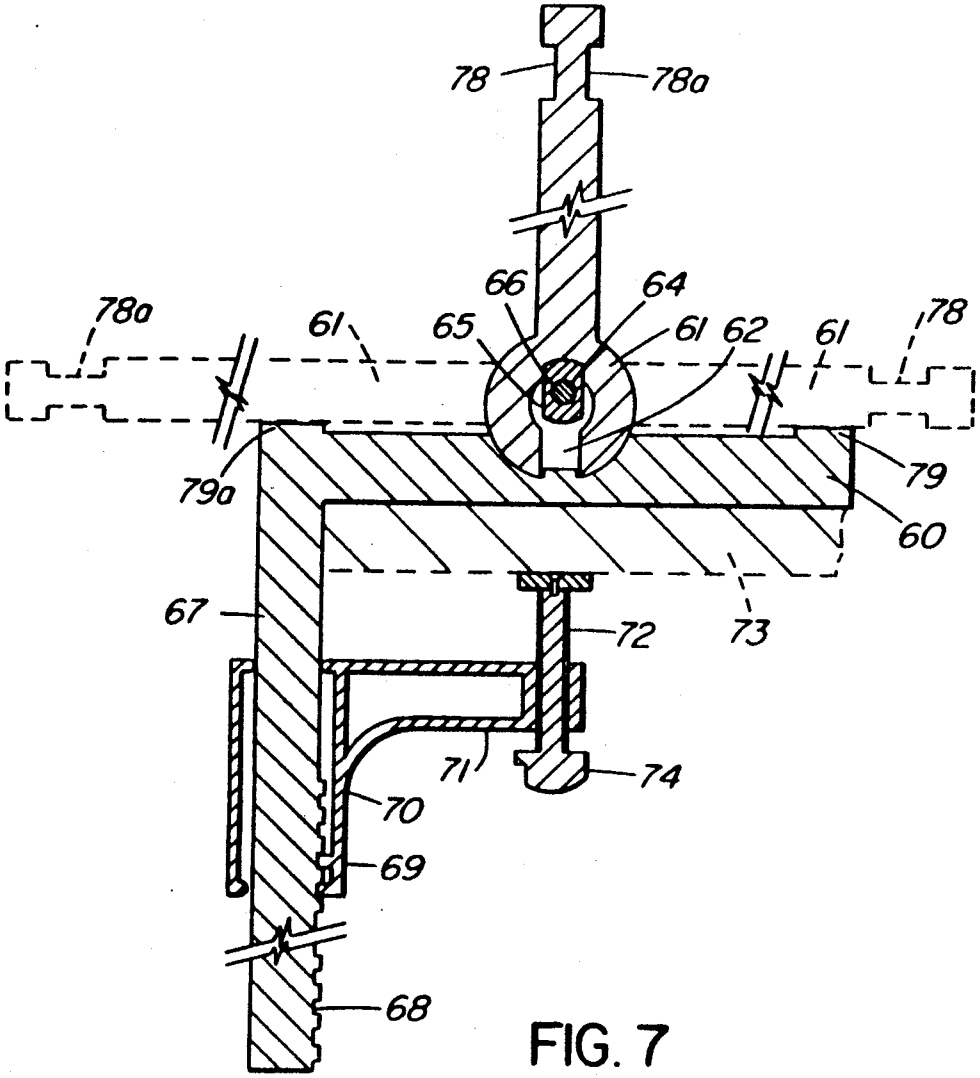
FIG. 7 is a sectional elevation view of an alternative embodiment of this invention.

FIG. 7 is a sectional elevation view and FIG. 8 is an end elevation view, partly in section, of an alternative embodiment for holding a ski tip or tail and in which a clamp is integral with the mounting portion.

FIG. 7 illustrates a base 60 recessed to receive a ski tip or tail holding arm 61 having an open slot 62 similar to that of tongue 21 in the embodiment of FIGS. 1–6.

Boss portion 64 has flattened sides 65 for movement through slot 62 and is mounted on pin 66 as previously described, so that arm 61 can swing to the positions indicated in phantom lines.

Base 60 is integrally connected to supporting post 67 which has a ratchet 68 engaged by ratchet teeth 69 within sleeve 70. A clamping arm 71 extends from sleeve 70 and supports clamp 72, which is tightened against table 73 by turning knob 74.

As shown in FIG. 8 pin 66 has knob 75 which can tighten boss 64 against holding arm 61 to clamp arm 61 to mounting plate 76. Mounting plate 77 retains boss 64 against rotation as previously described.

The main difference between the embodiment of FIGS. 7 and 8 and that of FIGS. 1 to 6 is that ski tip or tail holding arm 61 has recesses 78 and **78*a* adjacent its free end, one of which recesses will engage a ski intermediate its binding and its tip or tail when the base of the ski is vertical. This will support the ski when the operator is working on the ski. In one position, when the arm 61 is in the right hand position as shown in FIG. 7, with arm 61 resting against stop 79, recess 78 will be uppermost and will hold the ski; and when it is in the left hand position, resting against stop 79*a*, recess 78*a* will be uppermost. When arm 61 is vertical the ski will be supported on top of arm 61. A three piece unit may thus be provided including a structure as in FIGS. 1 to 6 to hold the ski and a pair of devices as shown in FIGS. 7 and 8** to support the tip and tail.

Figure 10:
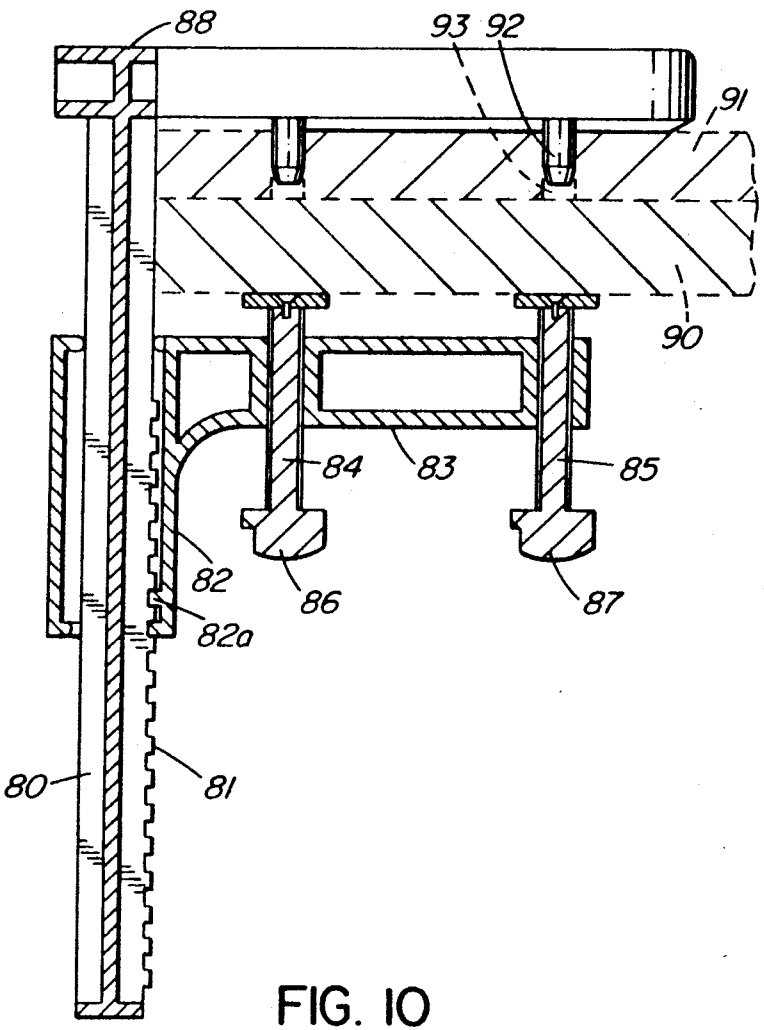
FIG. 10 is a sectional view on the line 10—10 of FIG. 9.
Figure 9:
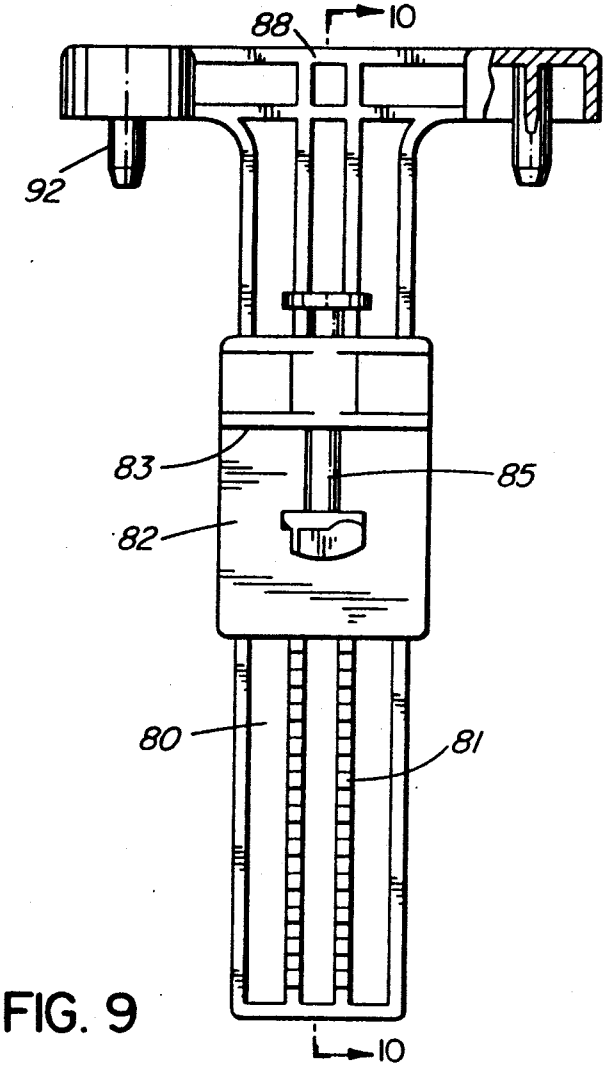
FIG. 9 is an end elevation view of a clamp.

Referring now to FIGS. 9 and 10, these illustrate a clamp particularly suitable for use in place of the bolts used to secure the base in the embodiment of FIG. 1 of the drawings. These drawings show a post 80, having ratchet teeth 81. A sleeve 82 slides on post 80 and has ratchet teeth **82*a* to engage teeth 81 at any desired vertical height. Clamping arm 83 extends from sleeve 82 and supports clamps 84 and 85 having knobs 86 and 87**.

At the top of post 80 there is a beam 88 which extends over the top of table 90 and the base plate 91 of a ski holding device of the type shown in FIG. 1. Beam 88 has downwardly extending projections 92 which engage bolt holes 93 of base plate 91.

Figures 11, 12:
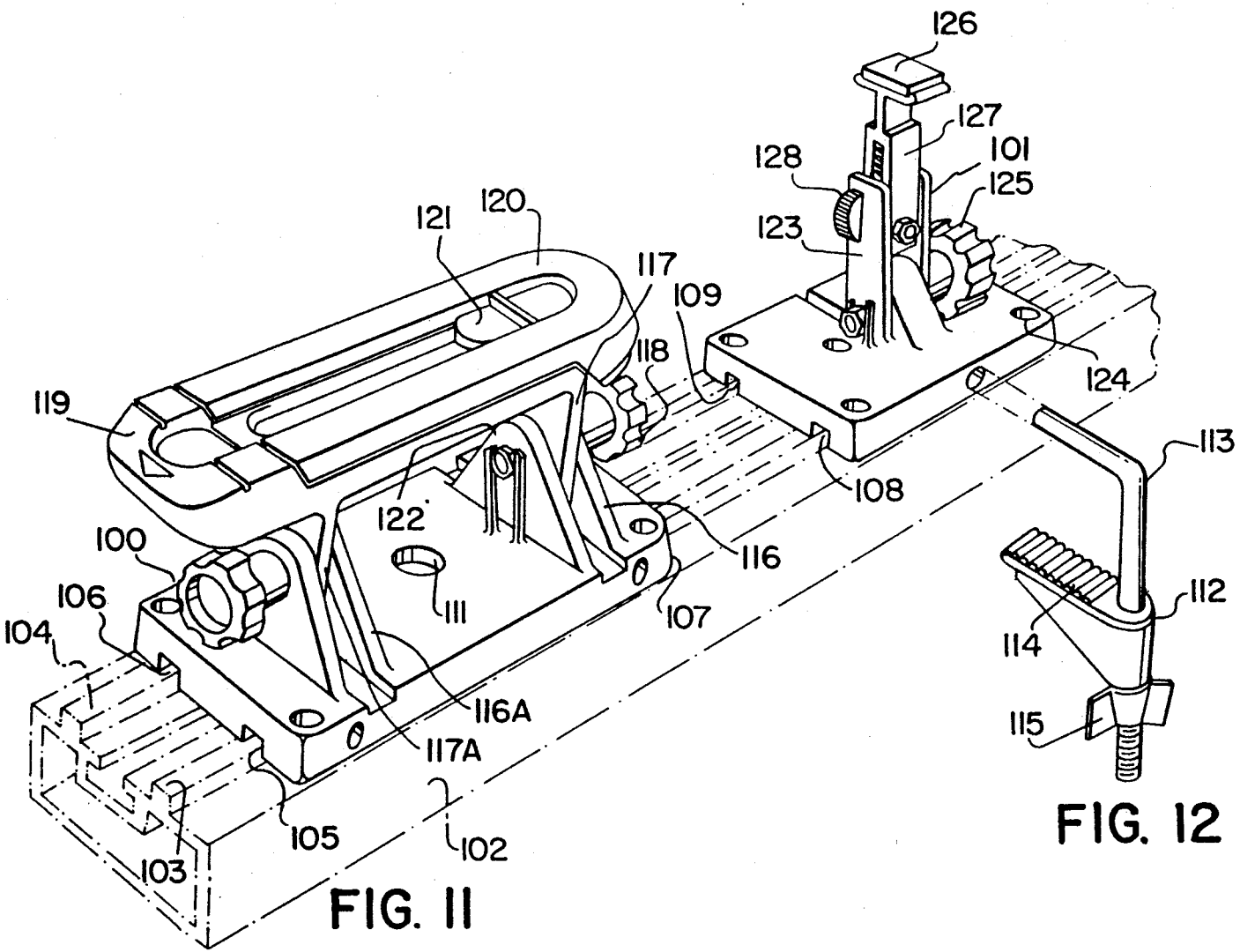
FIG. 11 is a perspective view of a ski holding device in accordance with another embodiment of this invention.
FIG. 12 is a perspective view of a clamp for use with the embodiment of FIG. 11.

FIG. 11 illustrates a further embodiment comprising a ski holding device 100 and a tip or tail support 101 mounted on an extrusion 102. In this embodiment extrusion 102 includes a pair of rails 103 and 104 engaged by grooves 105 and 106 in the base 107 of ski holding device 100. Similarly, rails 103 and 104 are engaged by grooves 108 and 109 of tip or tail support 101. This results in the ski holding device 100 and the tip or tail support 101 being maintained in good alignment. Extrusion 102 also has an undercut channel 110 to receive a slide (not shown) which can be used to secure base 107 to extrusion 102 though bolt hole 111. Alternatively, base 107 may be clamped to extrusion 102 with a simple clamp such as clamp 112 shown in FIG. 12. Clamp 112 comprises L-shaped upper clamping member 113, lower clamping member 114 and wing nut 115. The ski holding device also includes two pairs of mounting plates 116 and **116*a* extending upwardly from base 107, one pair from the front and one from the rear. Each pair receives a dependent tongue 117 or 117*a* which is slotted as shown in FIG. 4 to allow for easy removal rotation and reclamping. A pair of knobs 118 may be tightened to secure tongue 117** in its desired position.

Tongues 117 are illustrated as being integral with a toe piece 119. A heel piece 120 is slidably secured to toe piece 119 by side 121 to accommodate different boot sizes. Knob 122 may be tightened to maintain toe piece 119 and heel piece 120 in a desired relation.

Tip or tail support 101 has a web 123 rotatably secured to base 124 by clamping knob 125. A tip or tail support pad 126 has a support arm 127 which is slotted to telescope with respect to web 123 for extensible adjustment of the tip or toe support. Knob 128 tightens the support arm 127 to web 123 at a desired height of pad 123.

We claim:

1. A ski holding device for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; one part of the boot portion having a U-shaped section the base of which has transverse teeth, and the other part of the boot portion having a T-shaped section and having teeth at the stem of the T-shaped section to engage the transverse teeth of the U-shaped section to permit incremental adjustments to simulate ski boot sizes and releasable means for clamping the U-shaped section and the T-shaped section to lock said teeth in engagement; said mounting portion having a base and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, and holding means which can be tightened for maintaining the ski in each of said positions and in intermediate positions and additional means for locking the base in a horizontal and inverted position.

2. A ski holding device as in claim 1, in which the releasable means for clamping the U-shaped section and the T-shaped section comprises a longitudinal slot in the T-shaped section, extending through an upright stem of the T, a slide longitudinally movable in the slot, at least one aperture in the base of the U-shaped section, a bolt passing through the aperture and slot and engaging said slide so that the teeth of the U-shaped section and the teeth of the T-shaped section will be locked in engagement when the bolt is tightened and will be disengagable for ski boot size adjustment when the bolt is loosened.

3. A ski holding device as in claim 1, in which the supporting tongue is offset in the direction of the front part of the boot portion to provide balanced support for the ski.

4. A ski holding device as in claim 1, in which the boot portion is adapted to retain a brake on the ski in raised position.

5. A device as in claim 1, wherein the sole presents a toe portion and a heel portion, each of which portions presents a lip which is adapted to engage ski bindings.

6. A ski holding device as in claim 1, in which the boot portion has at least one supporting tongue dependent from the front part and at least one supporting tongue dependent from the rear part of the boot portion and in which at least one mounting plate extends upwardly from the base to face each dependent tongue.

7. A ski holding device for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; said mounting portion having a base and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, said supporting tongue having an open slot engaging the means for pivotally connecting the mounting plate and supporting tongue so that when the holding means is loose, the boot portion with its toe piece pointing in one direction can be disengaged from the mounting portion and replaced with the toe piece of the boot portion pointing in a direction opposite to said one direction and holding means which can be tightened for maintaining the ski in each of said positions and in intermediate positions and additional means for locking the base in a horizontal and inverted position.

8. A ski holding device for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; said mounting portion having a base and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, and in which the means for maintaining the ski in each of said positions comprises a boss and means for pressing the boss against the dependent tongue to hold said tongue between the boss and the upwardly extending mounting plate, and holding means which can be tightened for maintaining the ski in each of said positions and in intermediate positions and additional means for locking the base in a horizontal and inverter position.

9. A ski holding device as in claim 8, in which there is a pair of mounting plates between which the supporting tongue is sandwiched, one of said mounting plates acting to hold the boss against rotation.

10. A ski holding device as in claim 8, in which the dependent tongue has a downwardly extending open slot and in which the means for pressing the boss against the dependent tongue comprises a bolt passing through said open slot and threadably engaging said boss, whereby the boot portion can readily be disengaged from the mounting portion.

11. A ski holding device as in claim 10, in which there is a stop means to hold the ski with the base of the ski horizontal and inverted comprising a locking projection engagable with the open slot in the dependent tongue to hold the ski, but disengagable to permit pivoting of the boot portion.

12. A ski holding device as in claim 11, in which the boss is shaped so that pivoting of the boot portion will occur with the locking projection disengaged but the boss will slide in said open slot so that the boot portion will move down to engage said locking projection when the base of the ski attached to the boot is horizontal and inverted.

13. A ski holding device as in claim 8, comprising stop means firmly to hold the ski in a position in which the base of the ski is horizontal and inverted.

14. A ski holding device for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; said mounting portion having a base and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, and holding means which can be tightened for maintaining the ski n each of said positions and in intermediate positions and additional means for locking the base in a horizontal and inverted position.

15. A ski holding device comprising a ski holding member and a mounting member, said mounting member comprising a base, a mounting bracket, pivot means to permit said ski holding portion to pivot between a position in which a ski engaged by the ski holding member has its base vertical with one side edge uppermost and a position in which the base is vertical with the other side uppermost, clamping means for tightening the pivot and stop means for locking the pivot with the ski in a horizontal and inverted position, the ski holding member having at one end an open ended slot adapted to engage said pivot means and also to permit downward movement of the ski holding member to engage the stop means when the ski holding member is upright while permitting pivotal movement free of the stop means at other positions of the ski holding portion, and said ski holding member having at its other end means for holding a ski.

16. A ski holding device as in claim 15, in which the means for holding a ski comprises at least one recess to engage a ski intermediate its binding and its tip or tail.

17. A ski holding device as in claim 16, in which the means for holding a ski comprises a pair of laterally facing notches adjacent the free end of the ski holding member, one of which notches will engage a ski intermediate its binding and its tip or tail when the base of the ski is vertical and when one side edge of the ski is uppermost and the other of which notches will engage the ski intermediate its binding and its tip or tail when the base of the ski is vertical with the other of the side edges of the ski uppermost.

18. A ski holding device as in claim 15, in which the means for holding a ski comprises a boot portion adapted to fit into a ski binding simulating a ski boot.

19. A ski mounting device adapted to hold a ski comprising:

(a) a base adapted to be secured to a stationary support, said base including an upstanding pivot means;

(b) a ski retaining means comprising a generally flat sole having the approximate width of a ski boot sole, and adjustable as to length to simulate ski boot soles of varying lengths, said sole presenting a retention means adapted to cooperate with the upstanding pivot means on the base, for adjustable and pivotable retention on the base, said sole being adapted to cooperate with bindings on a ski for retention of said ski on said sole, thus permitting work operations on the bottom surface or either edge of said ski, said retention means being a tongue dependent from said sole, said tongue including a central slot which runs to the lower surface of said tongue, said central slot providing means for locking the tongue to the upstanding pivot means when said tongue is placed in a vertical position through engagement of said central slot with a stop, said stop being located on the base of said upstanding pivot means, and (c) a pivot holding the sole and base together, said pivot being provided with means for rotating the sole from an upwardly directed horizontal position through to outwardly facing vertical positions and positions intermediate thereof;

(d) said upstanding pivot means including means for locking said sole in said upwardly directed horizontal position.

20. The ski mounting device of claim 19, wherein said sole is comprised of interlocking elongated front and rear portions slidably and adjustably mounted one within the other so as to allow for adjustment of the length of the sole to accommodate the mounting of skis with bindings over varying lengths, said front and rear portions respectively being provided with a toe portion and a heel portion.

21. A ski holding device for use in the maintenance of skis with bindings including a toe piece and a heel piece comprising a boot portion simulating a ski boot and a mounting portion for said boot portion; said boot portion having an upper section including a front part adapted to engage a toe piece of an inverted ski, a rear part adapted to engage a heel piece and means for adjusting the spacing between the rear part and the front part to simulate different sizes of ski boot, said boot portion also having a lower section comprising at least one supporting tongue dependent from the upper section; said mounting portion having a base having bolt holes and at least one mounting plate extending upwardly from the base to face the supporting tongue, means for pivotally connecting the mounting plate and supporting tongue to permit the ski to be oriented to positions in which the base of the ski is horizontal and inverted, and in which the base is vertical with one side edge uppermost, and vertical with the other side edge uppermost, and holding means which can be tightened for maintaining the ski in each of said positions and in intermediate positions and additional means for locking the base in a horizontal and inverted position, and a table clamp comprising clamping arms adapted to overlie said base, projections, dependent from the clamping arms, engagable with said bolt holes, a downwardly extending supporting post for said clamping arms, an arm connected to the supporting post to permit vertical adjustment of the position of the arm, said arm being adapted to extend beneath said table, at least one screw clamp member on the arm to clamp the table clamp to the table.

22. A ski holding device for a ski having a tip, a tail and portion intermediate the tip and tail, comprising a ski holding member and a mounting member, said mounting member comprising a base, a mounting bracket, pivot means to permit said ski holding member to pivot between a position in which a ski engaged by the ski holding member has its base vertical with one side edge uppermost and a position in which the base is vertical with the other side uppermost, clamping means for tightening the pivot, stop means on one of the mounting member and the ski holding member adapted to engage a recess in the other of the mounting member and the ski holding member, the ski holding member having means for holding a ski and having a longitudinal elongated slot adapted to engage said pivot means and also to permit downward movement of the ski holding member to engage said stop means and said recess when the ski holding member is upright while permitting pivotal movement free of the stop means at other positions of the ski holding member.

23. A ski holding device as in claim 22, in which the ski holding member has a supporting pad to engage the tip or tail of a ski and in which the ski holding portion is of adjustable length.

* * * * *